US011447285B2

(12) United States Patent
Franzen

(10) Patent No.: US 11,447,285 B2
(45) Date of Patent: Sep. 20, 2022

(54) CONTAINER FOR CONSUMER GOODS WITH AN INSERT AND METHOD OF MANUFACTURING SUCH A CONTAINER

(71) Applicant: JT International S.A., Geneva (CH)

(72) Inventor: Jens Franzen, Hentern (DE)

(73) Assignee: JT International S.A.

( * ) Notice: Subject to any disclaimer, the term of this patent is extended or adjusted under 35 U.S.C. 154(b) by 0 days.

(21) Appl. No.: 17/048,844

(22) PCT Filed: May 17, 2019

(86) PCT No.: PCT/EP2019/062801
§ 371 (c)(1),
(2) Date: Oct. 19, 2020

(87) PCT Pub. No.: WO2019/219908
PCT Pub. Date: Nov. 21, 2019

(65) Prior Publication Data

US 2021/0122516 A1 Apr. 29, 2021

(30) Foreign Application Priority Data

May 18, 2018 (EP) ..... 18173159

(51) Int. Cl.
*B65D 5/42* (2006.01)
*B65B 61/20* (2006.01)
(Continued)

(52) U.S. Cl.
CPC ..... *B65D 5/4233* (2013.01); *B65B 61/20* (2013.01); *B65D 5/662* (2013.01); *B65D 85/1081* (2013.01); *B65D 2203/02* (2013.01)

(58) Field of Classification Search
CPC ..... B65D 5/42; B65D 5/4233; B65D 5/662; B65D 85/10; B65D 85/1081; B65D 2203/02; B65B 61/20
(Continued)

(56) References Cited

U.S. PATENT DOCUMENTS 7,392,899 B2 * 7/2008 Pham ..... B65D 85/1054 206/264
8,141,701 B2 * 3/2012 Hodges ..... B65D 5/4233 206/268
(Continued)

FOREIGN PATENT DOCUMENTS

CN 206423569 U 8/2017
CN 107125805 A 9/2017
(Continued)

OTHER PUBLICATIONS

International Search Report for Application No. PCT/EP2018/062846 dated Jul. 30, 2019, 3 pages.

*Primary Examiner* — Bryon P Gehman
(74) *Attorney, Agent, or Firm* — Lerner, David, Littenberg, Krumholz & Mentlik, LLP

(57) ABSTRACT

A container for consumer goods includes an outer housing including a box portion and a hinged lid portion pivotable between open and closed positions, an inner package arranged within the outer housing, the inner package including an access opening, an insert that can be pulled out of the container, including a front panel and at least a first side panel that are connected to each other, and wherein the front panel is arranged between a front wall of the inner package and a front wall of the box portion, and the first side panel is arranged between a first side wall of the inner package and a first side wall of the box portion, and the first side panel includes a first grasp portion that extends above the first side
(Continued)

Figure 1:
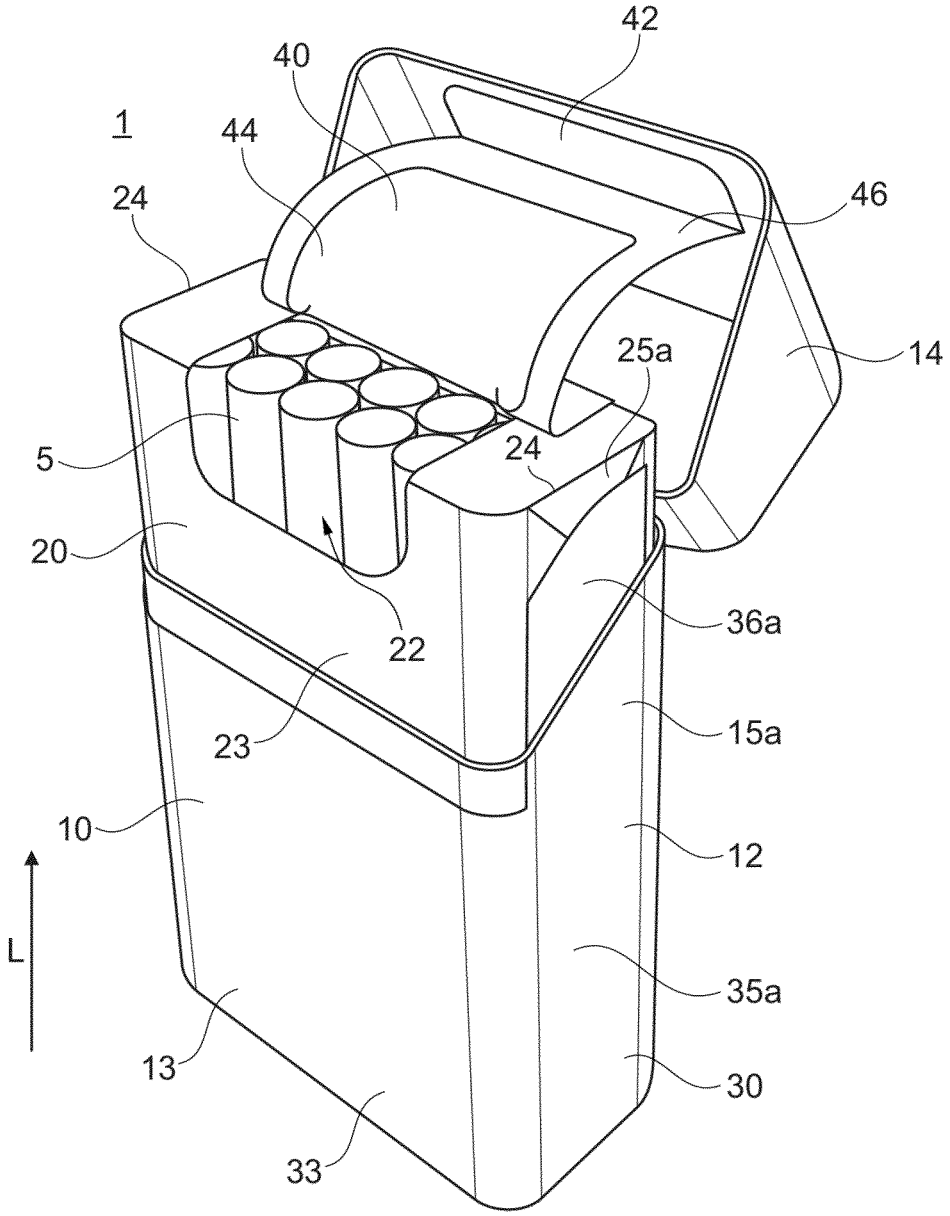

wall of the box portion in a longitudinal direction, when the insert is in a retracted position.

16 Claims, 15 Drawing Sheets

(51) Int. Cl.
*B65D 5/66* (2006.01)
*B65D 85/10* (2006.01)

(58) Field of Classification Search
USPC ..... 206/232, 264, 265, 268
See application file for complete search history.

(56) References Cited

U.S. PATENT DOCUMENTS

| | | | | |
|---|---|---|---|---|
| 9,872,520 | B1 | 1/2018 | Elson | |
| 10,633,170 | B2 * | 4/2020 | Slooff | B65D 5/4233 |
| 10,661,975 | B2 * | 5/2020 | Slooff | B65D 85/1081 |
| 2011/0017762 | A1 * | 1/2011 | Emmett | B65D 85/1009 206/254 |
| 2015/0027916 | A1 | 1/2015 | Buse | |
| 2017/0197778 | A1 | 7/2017 | Slooff | |
| 2018/0334317 | A1 * | 11/2018 | Slooff | B65D 85/1081 |

FOREIGN PATENT DOCUMENTS

| | | | |
|---|---|---|---|
| CN | 107752130 | A | 3/2018 |
| JP | 2007060903 | A | 3/2007 |
| JP | 2017529288 | A | 10/2017 |
| KR | 20140074393 | A | 6/2014 |
| WO | 2014042574 | A1 | 3/2014 |
| WO | 2015011621 | A1 | 1/2015 |
| WO | 2016059366 | A1 | 4/2016 |
| WO | 2016087818 | A1 | 6/2016 |
| WO | 2017072605 | A1 | 5/2017 |
| WO | 2017072606 | A1 | 5/2017 |
| WO | 2017072624 | A1 | 5/2017 |
| WO | 2017194751 | A1 | 11/2017 |
| WO | 2018054793 | A1 | 3/2018 |

* cited by examiner

CONTAINER FOR CONSUMER GOODS WITH AN INSERT AND METHOD OF MANUFACTURING SUCH A CONTAINER

CROSS-REFERENCE TO RELATED APPLICATIONS

The present application is a national phase entry under 35 U.S.C. § 371 of International Application No. PCT/EP2019/062801, filed May 17, 2019, published in English, which claims priority to European Application No. 18173159.7 filed May 18, 2018, the disclosures of which are incorporated herein by reference.

1. TECHNICAL FIELD

The present invention relates to a container for consumer goods, an insert for insertion into such a container and a corresponding method of manufacturing such a container. Thereby, the container is in particular suitable for storing tobacco articles, like cigarettes.

2. PRIOR ART

Fragile goods, like for instance cigarettes, are usually packaged and brought into market in small containers in order to protect the goods during transport. Such containers can be made of renewable raw material like paperboard and often comprise a structured composition. Thereby, a softer, odorless and unflavored inner package directly stores the consumer goods, while a harder outer housing forms the container and protects the goods against environmental conditions and impacts from the outside. In some cases, the outer housing comprises a hinged lid for closing and opening of the container. The container additionally is wrapped in a transparent plastic foil for further protection and as integrity seal.

In modern containers for consumer goods, the inner package often comprises a resealable flap above its access opening in order to seal the consumer goods additionally against environmental conditions like air, humidity and the like. Thereby, the resealable flap is in general attached to the inner package by a re-sealable adhesive surface such that the flap can be adhered to the inner package and removed from it many times.

Furthermore, modern containers for consumer goods may comprise additional inserts. These inserts are arranged inside the containers and are removed during first use or first access to the container. In general, these inserts contain additional messages for the consumer like a seal of quality, advertisements, health-related notes, raffles or the like. An insert essentially comprises a larger text field and some grasp portion for pulling the insert out of the container in order to read the message on the text field.

In the prior art several kinds of inserts are known. For example, document WO 2015/011621 A1 describes a packet for smokers' articles comprising an outer container and an inner wrapper, wherein the inner wrapper has an opening for extracting the smokers' articles. A coupon is arranged at the front side of the container and is adhered to respective zones of the wall of the inner wrapper.

Document WO 2016/059366 A1 describes a pack comprising a base, wherein the base contains a group of tobacco industry products wrapped in a barrier layer to form a bundle. Furthermore, an insert is located at the front side within the bundle between the tobacco industry products and the front wall of the barrier layer.

Document WO 2016/087818 A1 describes a pack comprising a base having a front wall and containing a tobacco industry product wrapped in a barrier layer to form a bundle. Furthermore, the pack is comprising a flexible insert that is attached to a label such that, when the label is peeled away from the barrier layer, the insert is at least partially extracted from the pack.

Document WO 2017/072606 A1 describes a container that comprises a housing that comprises a box and a lid that is swing-hinged attached to the box. The container also comprises an insert comprising a line of weakness and a communication portion, wherein the insert is coupled to a resealable label to maintain connection of the insert with the container until the line of weakness is broken.

Documents WO 2017/072605 A1 and WO 2017/072624 A1 describe a container and a method of manufacturing such a container, wherein the container comprises an insert positioned between an inner surface of the front wall of the box and the outer surface of the front wall of the inner package. Thereby, the insert is positioned entirely below a sealing region and is positioned so that the lowest point of the upper edge of the box is lower than the highest point of the upper edge of the insert.

In the above-described prior art, said grasp portions for pulling the insert out of the container are arranged at the front side of the container such that a consumer can easily spot and pay attention to the grasp portion and the insert, respectively. However, a large grasp portion interferes with an easy access to the consumer goods. Furthermore, with the upcoming of the resealable flaps the risk occurs that the grasp regions interfere with these flaps and prevent a secure and tight (re-)closing of the inner package. On the other hand, a small grasp region is more difficult to be grasped by a consumer, thus, complicates pulling out of the insert.

It is the problem of the present invention to provide a container for consumer goods, an insert for insertion into such a container and a method of manufacturing such a container that complies with the above-mentioned requirements and constraints.

3. SUMMARY OF THE INVENTION

The above-mentioned problem is solved by a container for consumer goods according to claim 1, an insert for insertion into a container for consumer goods according to claim 11 and a method of manufacturing a container for consumer goods according to claim 13.

The above-mentioned problem is in particular solved by a container for consumer goods comprising an outer housing comprising a box portion and a hinged lid portion for closing the container, wherein the lid portion is pivotable between an open and a closed position, an inner package for storing consumer goods, wherein the inner package is arranged within the outer housing and the inner package comprises an access opening through which consumer goods can be taken out, an insert that can be pulled out of the container, comprising a front panel and at least a first side panel, wherein the front panel and the first side panel are connected to each other, and wherein the front panel is arranged between a front wall of the inner package and a corresponding front wall of the box portion, and the first side panel is arranged between a first side wall of the inner package and a corresponding first side wall of the box portion, and the first side panel comprises a first grasp portion that extends above said first side wall of the box portion in a longitudinal direction, when the insert is in a retracted position.

In the container according to the present invention a grasp portion for an insert can be provided that is sufficiently large such that even a less dexterous person can grasp the insert and pull it out of the container easily while the grasp portion does not negatively affect access to the inner package. This is in particular achieved by arranging the grasp region at a lateral side of the container instead of at the front side as it is done in the prior art. In addition to that, the front panel of the insert is completely covered behind the front wall of the box portion of the container and does not hinder access to the inner package, too.

Preferably, the first grasp portion extends beyond the height of the front panel in said longitudinal direction and wherein the front panel is completely arranged below an upper edge of said front wall of the box portion, when the insert is in its retracted position. Because of this structural configuration of the insert it is possible to cover the front panel of the insert while the sideways grasp portion is still visible. Moreover, this still holds for container configurations in which the upper end of the box portion ascends in direction to the back wall of the container, since the grasp portion significantly extends beyond the height of the front panel of the insert. Thereby, it is ensured that a consumer can easily spot the grasp portion and pull out the insert to see and read the message it contains.

Preferably, the container is furthermore comprising a reclosable flap which is connected and moveable relative to the inner package, wherein the access opening can be covered by said reclosable flap for sealing the inner package. A reclosable flap further seals the consumer goods inside the inner package in particular against air, dust and humidity. Thereby, the flap is usually slightly broader than the actual access opening in order to ensure an air-tight closing of the access opening. Furthermore, the flap is usually connected to the inner package by a specific adhesive in order to enable an easy and fast opening and closing over multiple times.

Preferably, the insert and the reclosable flap do not overlap, when the insert is in its retracted position. This enables a free use of the reclosable flap. Thereby, retracted position preferably means a position of the insert in which the front panel of the insert is completely interposed or retracted between the front walls of the box portion and the inner package.

Preferably, the first grasp portion essentially extends to the upper end of the inner package. In that at least a peak of the grasp portion extends up to the upper end of the inner package, the grasp portion provides a grasping area as large as possible. Thereby, a larger grasp portion facilitates the grasping and pulling out of the insert in particular for individuals with reduced handling capabilities.

Preferably, the insert further comprises a second side panel arranged at an opposite side to the first side panel and the front panel and the second side panel are connected to each other, wherein the second side panel is arranged between a second side wall of the inner package and a corresponding second side wall of the box portion. The second side panel increases the stability of the insert. This is in particular advantageous for the manufacturing process in which a stable structure of the insert is desired for a better material handling.

Preferably, the second side panel comprises a second grasp portion that extends above said second side wall of the box portion in said longitudinal direction, when the insert is in its retracted position. In providing an additional second grasp portion the user can pull out the insert by any of these two grasp portions which increases user friendliness. Furthermore, a grasp portion on each side of the container increases visibility of the grasp portion and, thus, the insert.

Preferably, the second grasp portion extends beyond the height of the front panel in said longitudinal direction. Thereby, like the first grasp portion also the second grasp portion is easily visible even when the front panel is fully hidden from external view in the retracted position as it is at least the case when a consumer opens the container for the first time.

Preferably, the first and/or second grasp portion comprises an arch-shaped upper-front edge. Preferably, the upper-front edge is essentially parallel to the radius of the pivoting movement of the lid portion. Because of this parallel arrangement the lid portion does not come into any unwanted contact with a grasp portion during opening and closing the lid portion which might crease the grasp portion. Thus, the insert can stay in its retracted position even after a first opening and closing of the container and might be pulled out during a later opening of the container.

Preferably, the first and/or second grasp portion comprises an indicium, indicating that the insert can be pulled out of the container. An indicium is a short and easy to understand message, here for indicating how to pull out the insert. Preferably, the message can be a word like "PULL" or as sign like an upward pointing arrow for example. The indicium can be printed or impressed to the grasp portion to facilitate grasping and may also enable an identification by blind people.

The above-mentioned problem is also solved by an insert for insertion into a container for consumer goods, the insert comprising a front panel and at least a first side panel, wherein the first side panel is connected to the front panel and the first side panel is arranged at an angle to the front panel, and the first side panel comprises a first grasp portion that extends beyond the height of the front panel in a longitudinal direction and is designed for pulling the insert out of a container.

Such an insert also realizes the above-mentioned advantages of not hindering any access to the consumer goods and not interfering with a resealable flap of the package but still providing a large grasping portion for the consumer.

Preferably, the insert is further comprising a second side panel that is connected to the front panel at an opposite side to the first side panel, and preferably, wherein the second side panel comprises a second grasp portion that extends beyond the height of the front panel in said longitudinal direction. The second side panel increases the visibility of the grasp portion such that a consumer can quickly identify one of the grasp portions of the insert. This increases user friendliness. Further the second side panel increases the size of the insert usable for the intended message.

The above-mentioned problem is also solved by a method of manufacturing a container for consumer goods, the method comprising the steps of providing a charge of consumer goods, wrapping sheet material around the consumer goods for forming an inner package, arranging a separate insert onto the inner package, the insert comprising a front panel and at least a first side panel, wherein the first side panel is connected to the front panel and both are arranged in an angle to each other, and the first side panel comprises a first grasp portion that extends beyond the height of the front panel in a longitudinal direction, and forming an outer housing of the container around the inner package and the insert such that the first side panel of the insert is arranged between a first side wall of the inner package and a first side wall of the outer housing and the front panel of the insert is arranged between a front wall of the outer housing and a front wall of the inner package.

This method of manufacturing also realizes the above-mentioned advantages that the insert is not hindering any access to the consumer goods and not interfering with a resealable flap of the package but still providing a large grasping portion for the consumer.

Preferably, the step of arranging the separate insert is performed prior to the step of forming the outer housing, or the step of arranging the separate insert is performed after the step of forming the outer housing and performed by fitting the insert between the inner package and the outer housing. In the first case, where the insert is arranged on the inner package prior to forming the outer housing, the insert can be easily placed into the outer housing while the outer housing is simply wrapped around the inner package with the insert. On the other hand, however, if the insert is inserted only into the ready-made container, then none of the already used processing steps for manufacturing a container has to be changed. The insert is simply introduced into the container afterwards.

Preferably, the method is further comprising the step of applying a reclosable flap to the inner package after arranging the insert onto the inner package. When the insert is arranged on the inner package, during the production of the inner package the outer housing can simply be wrapped around the inner package with the insert in a final step, which is an efficient manufacturing process. Furthermore, if the insert is arranged prior to the application of a reclosable flap any false or imprecise positioning of the insert can be prevented. Thus, it can be ensured that the insert does not overlay or otherwise hinder the opening of the reclosable flap during first access to the container.

Moreover, in general, it is advantageous for the manufacturing process of the container to prevent any overlap between the reclosable flap and the insert, as this allows applying the insert at different stages of the manufacturing process, which increases the flexibility of the design of the manufacturing facility.

4. SHORT DESCRIPTION OF THE DRAWINGS

Figure 2:
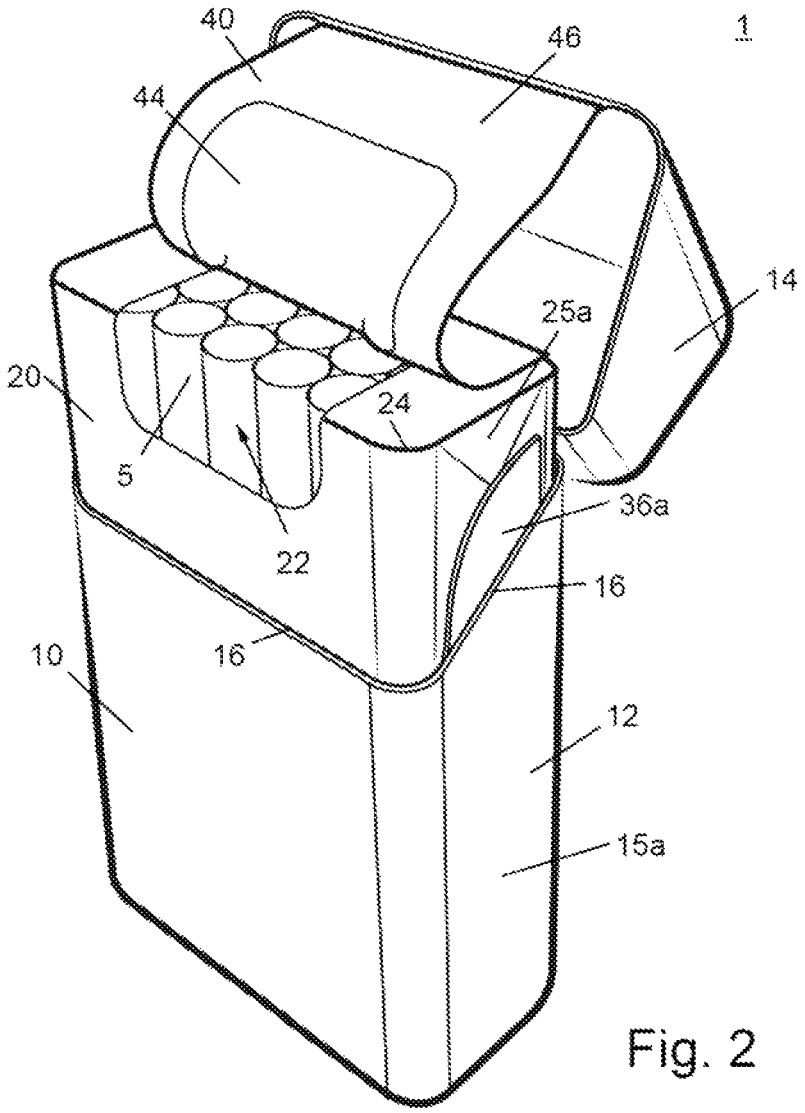
Figure 3:
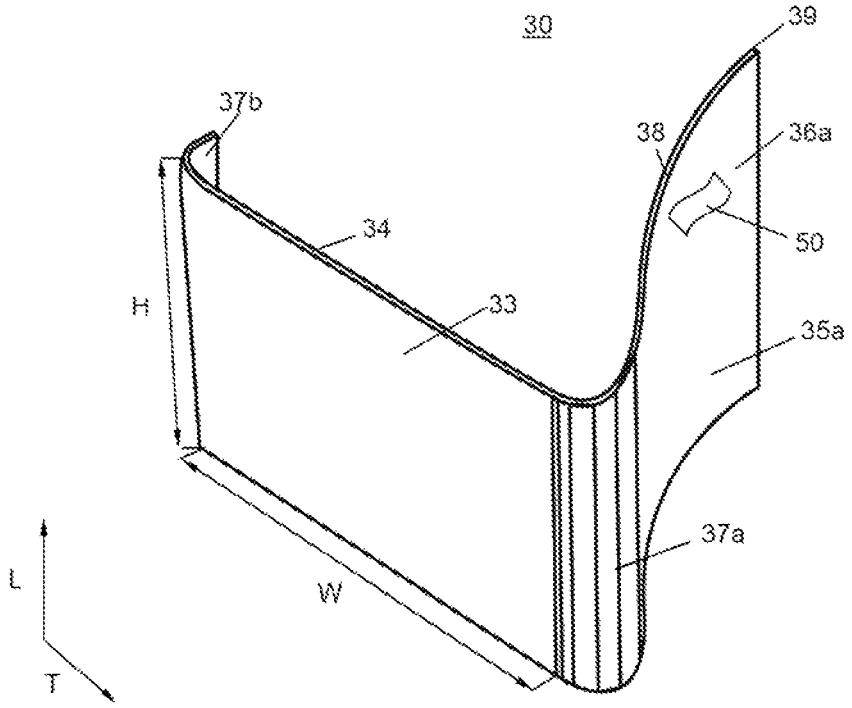
Figure 4A:
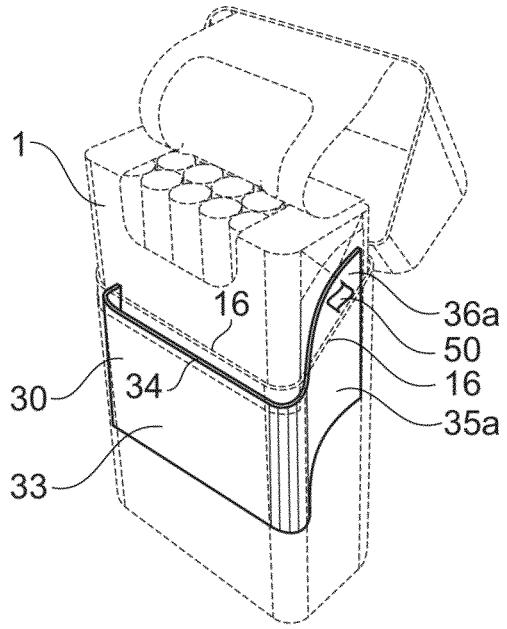
Figure 4B:
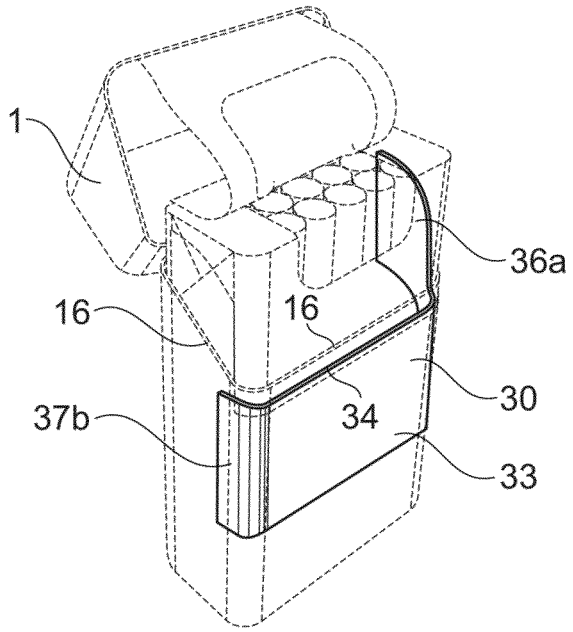
Figure 5B:
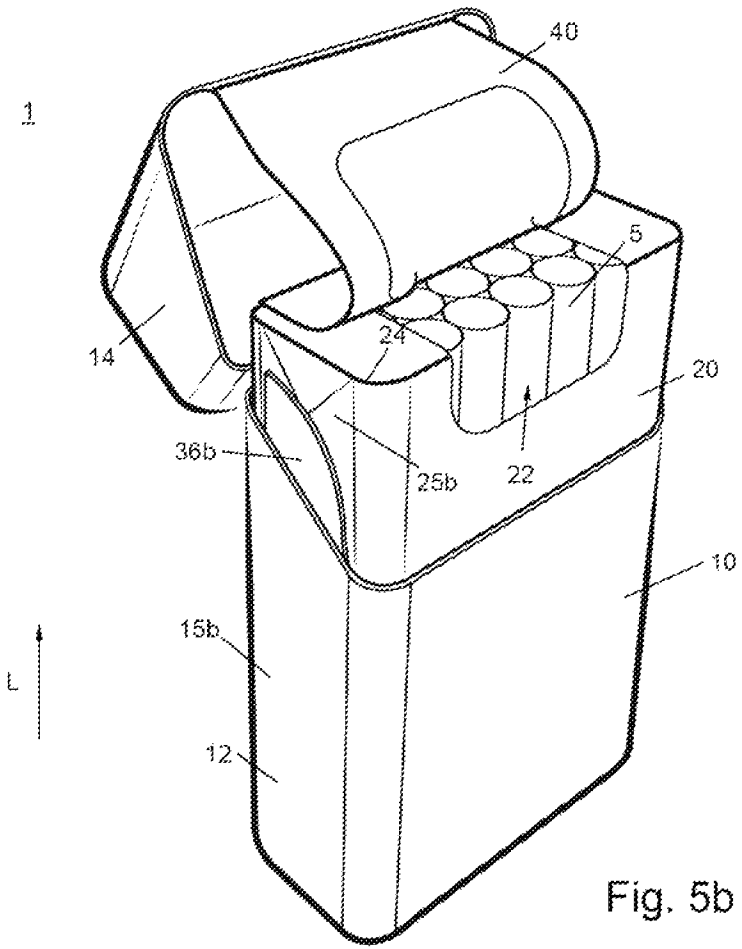
Figure 5A:
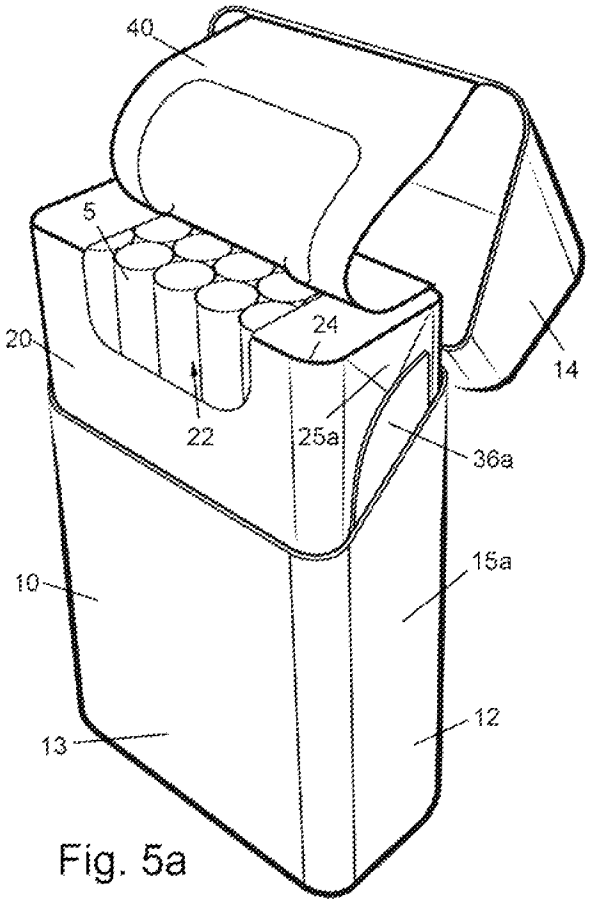
Figure 6:
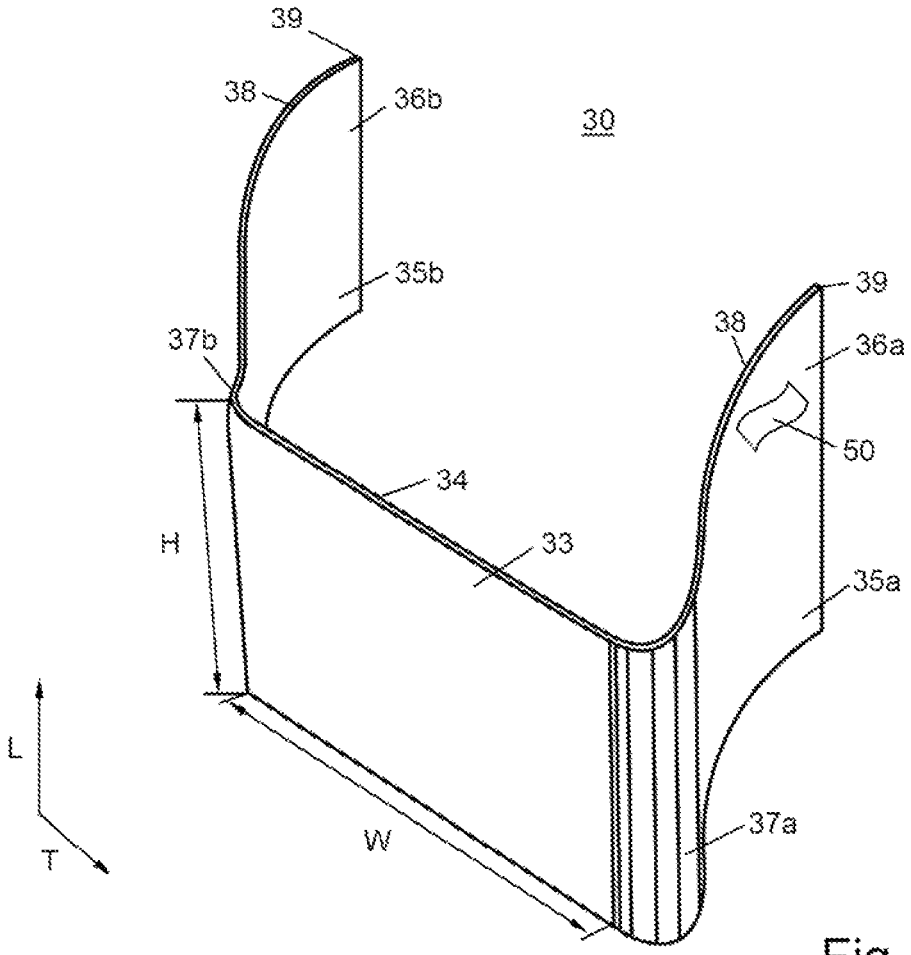
Figure 7A:
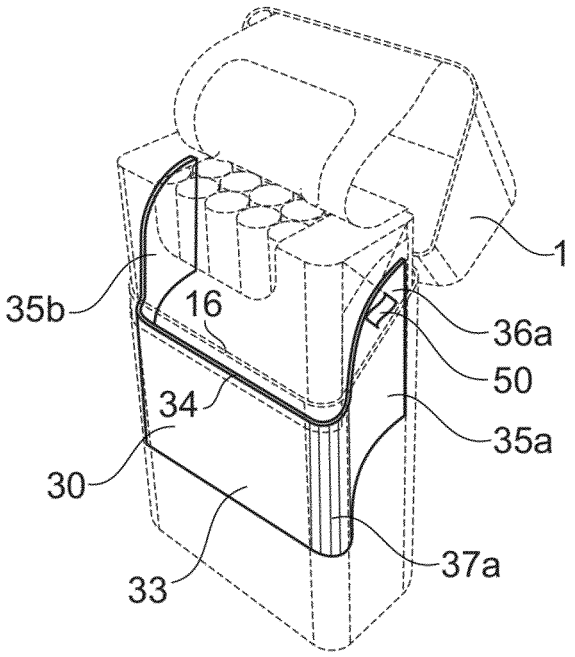
Figure 7B:
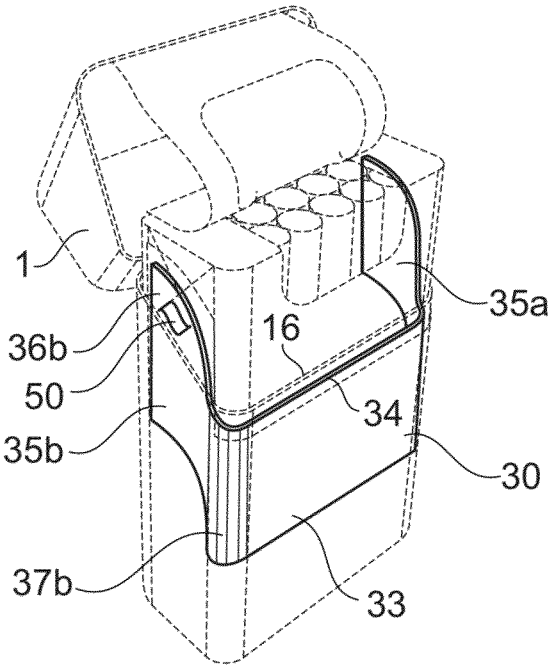
Figure 8B:
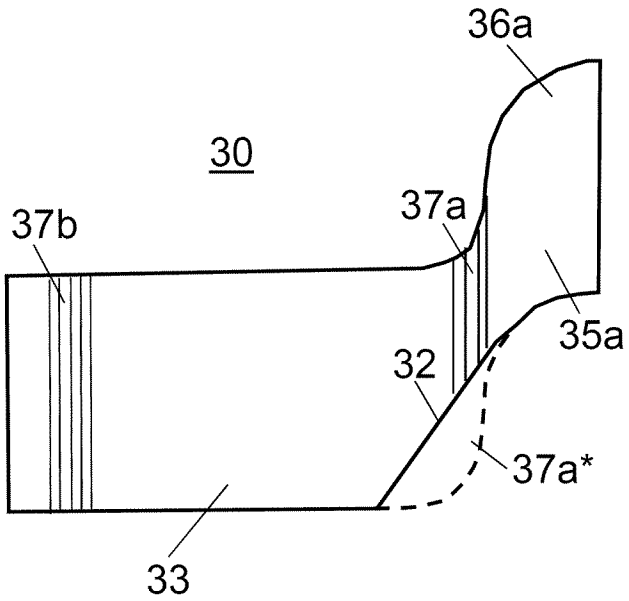
Figure 8A:
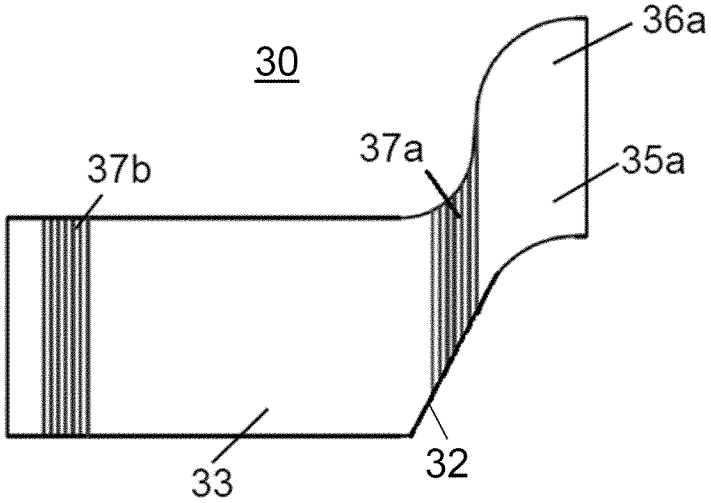
Figure 9:
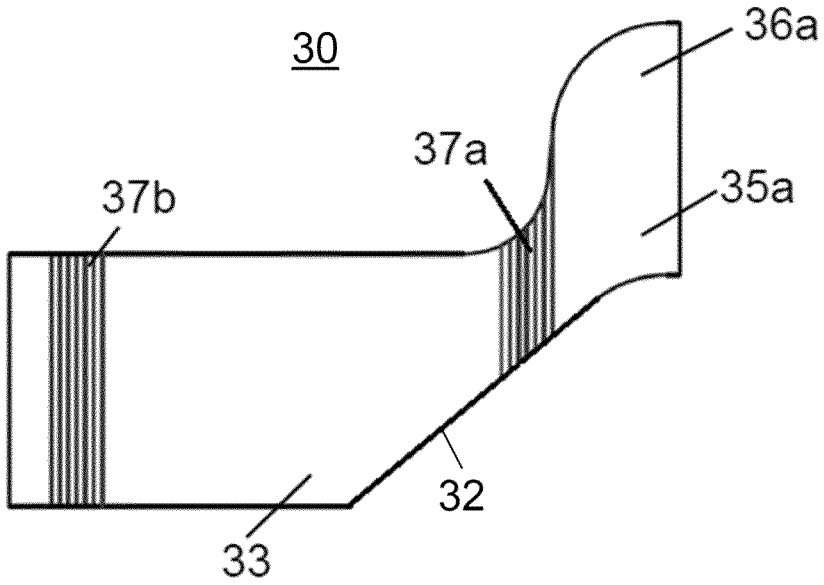
Figure 10C:
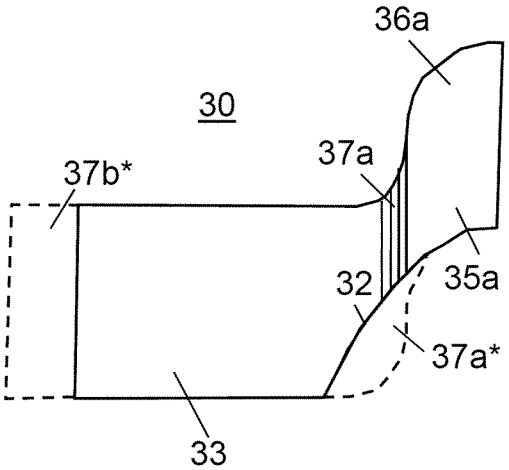
Figure 10B:
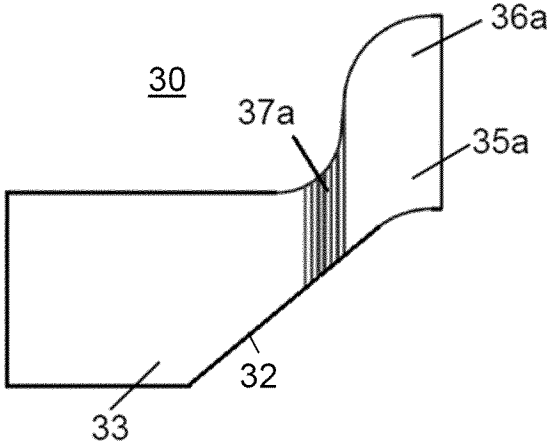
Figure 10A:
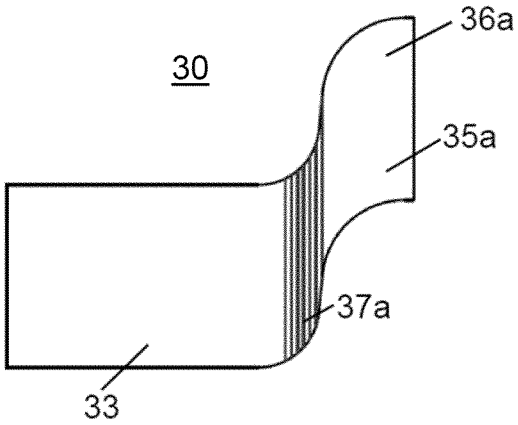
Figure 15:
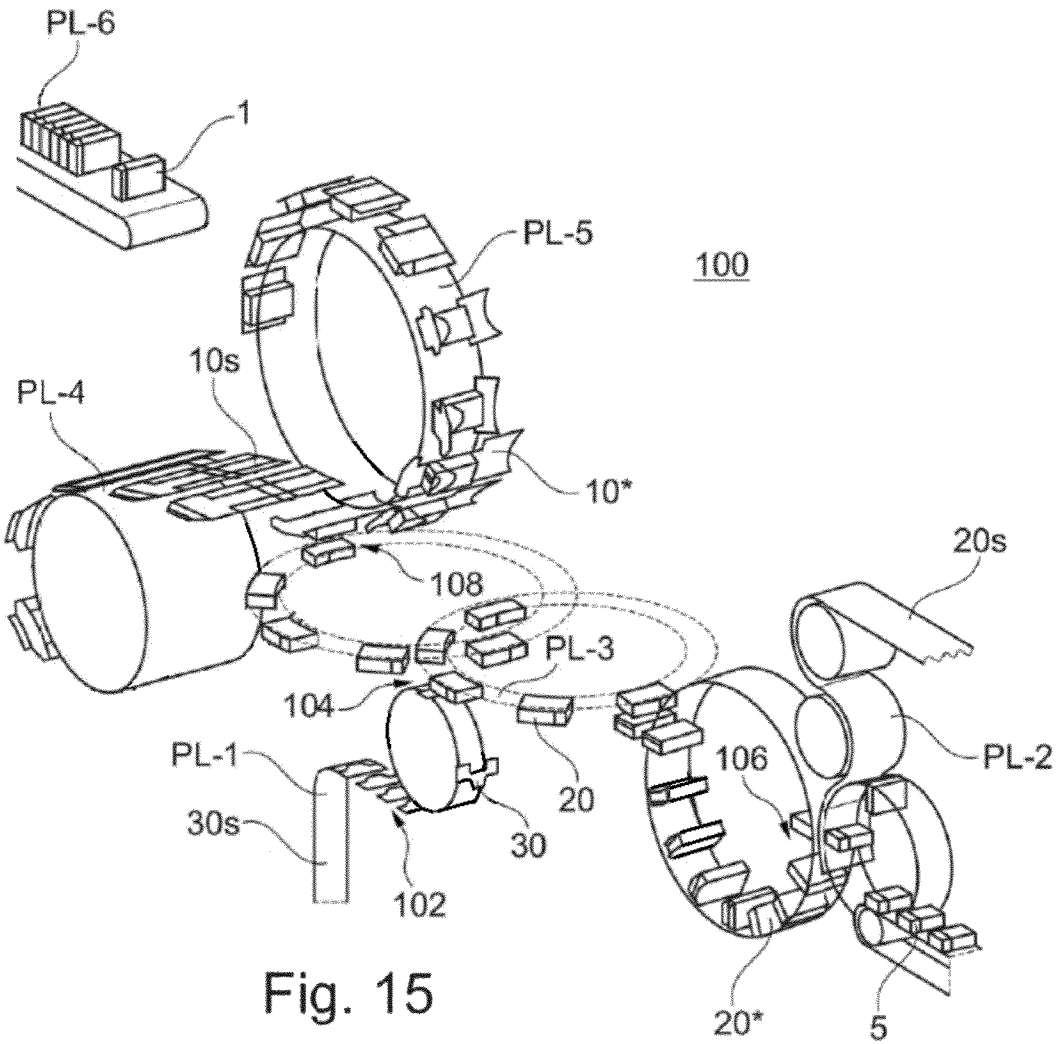

In the following, preferred embodiments of the invention are disclosed by reference to the accompanying figures, in which shows:

FIG. 1 a three-dimensional view of an embodiment of an open container indicating a partially hidden insert in the retracted position;

FIG. 2 a three-dimensional view of an embodiment of an open container with a first embodiment of an insert in the retracted position;

FIG. 3 a three-dimensional view of the first embodiment of an insert;

FIGS. 4*a*, 4*b* schematic three-dimensional views of the arrangement of the first embodiment of an insert in the retracted position in an embodiment of a container;

FIGS. 5*a*, 5*b* three-dimensional views of an embodiment of an open container with a second embodiment of an insert in the retracted position;

FIG. 6 a three-dimensional view of the second embodiment of an insert;

FIGS. 7*a*, 7*b* three-dimensional views of the arrangement of the second embodiment of an insert in the retracted position in an embodiment of a container;

FIGS. 8*a*, 8*b* a third embodiment of an insert in a schematic illustration (FIG. 8*a*) and in an overlay illustration with a contour of the first embodiment of an insert (FIG. 8*b*);

FIG. 9 a schematic illustration of a fourth embodiment of an insert;

FIGS. 10-10*c* a fifth embodiment of an insert similar to the first embodiment (FIG. 10*a*) and similar to the fourth embodiment (FIG. 10*b*) in a schematic illustration, and in an overlay illustration with a contour of the first embodiment (FIG. 10*c*);

FIGS. 11*a*-11*d* schematic illustrations of manufacturing steps arranging the first embodiment of an insert on an embodiment of an inner package from different perspectives;

FIGS. 12*a*-12*d* illustrations of an embodiment of a manufactured container with the first embodiment of an insert from different perspectives;

FIGS. 13*a*-13*e* illustrations of manufacturing steps arranging the second embodiment of an insert on an embodiment of an inner package from different perspectives;

FIGS. 14*a*-14*d* illustrations of an embodiment of a manufactured container with the second embodiment of an insert from different perspectives; and FIG. 15 a schematic illustration of a manufacturing facility.

5. DETAILED DESCRIPTION OF PREFERRED EMBODIMENTS

In the following, preferred embodiments of the invention are described in detail with respect to the figures.

FIG. 1 shows an embodiment of a container 1 comprising an insert 30. The container 1 has a generally cuboid shape. Its outer housing 10 is preferably made of stronger paper sheets or cardboard in order to provide a stable structure to the container 1 and to protect the consumer goods 5 inside.

The size of the container 1 comprises a height in longitudinal direction L of about 70 to 120 mm and a width of about 40 to 72 mm between a first lateral side 15*a* and a second lateral side 15*b*, and a thickness of about 16 to 25.5 mm from the front wall 13 of the container to its back wall.

The outer housing 10 of the container 1 further comprises a box portion 12 and a lid portion 14. The lid portion 14 is hingedly attached to the box portion 12 at the back side of the container 1 and can be brought manually from a closed position into an open position, as shown in FIG. 1. Thereby, the hinge of the lid portion 14 is made of a fold of the paper or cardboard of the outer housing 10 and can be easily manufactured. In the closed position the consumer goods 5 are fully protected inside the container 1, wherein in the open position access to the consumer goods 5 is given and for example a cigarette can be taken out from the container 1.

When the lid portion 14 and, thus, the container 1 is in the closed position, the insert 30 is not visible. Thus, for example surprising messages can be written to the insert 30 which are revealed not until the container 1 is opened and the insert 30 is pulled out by the consumer. The insert 30 of this embodiment comprises a front panel 33 and one side panel 35*a* having a grasp portion 36*a* at its upper end. When the lid portion 14 is in its open position and the insert 30 is in its retracted position, only the grasp portion 36*a*, 36*b* of the insert 30 is visible (see FIG. 2 and FIGS. 5*a*, 5*b*). The front panel 33 of the insert 30, however, is not visible and does not hinder a free access to the access opening 22 of the inner package 20. Thus, consumer goods 5 can be taken out easily from the inner package 20 and the container 1, respectively.

In case the inner package 20 is additionally sealed by a reclosable flap 40, the insert 30 does not overlay the reclosable flap 40 because the grasp portions 36*a*, 36*b* are arranged at first and second sides 15*a*, 15*b* of the box portion 12, only. The front panel 33 of the insert 30, however, is interposed between front walls 13, 23 of the box portion 12 and the inner package 20 when in its retracted position, and not visible to the consumer. Preferably, the front panel 33 is arranged fully below an upper edge 16 of the front wall 13 of the box portion 12.

A consumer may pay attention to a grasp region 36*a*, 36*b* due to its remarkable coloring. Any suitable contrast between the appearance of the grasp portion 36*a*, 36*b* and the appearance of the inner package 20 can be used in order to increase visibility of the grasp portion 36*a*, 36*b*. The contrast can be, for example, a color contrast or a finishing contrast, e.g. a matt inner package 20 and a glossy grasp portion 36*a*, 36*b*. Furthermore, a consumer may also pay attention to a grasp region 36*a*, 36*b* due to an indicium 50, that is applied to the grasp region 36*a*, 36*b* (see FIGS. 3, 4*a*, 6, 7*a* and 7*b*).

The indicium 50 can be provided by a printing medium, by one or more protrusions, by one or more depressions or a combination thereof. The indicium 50 can preferably be text, a symbol, an image, a pattern or a combination thereof.

The insert 30 is preferably made of paper material such that it is thin enough for fitting in-between the front walls 13, 23 of the box portion 12 and the inner package 20. On the other hand, the insert 30 must be strong enough to be pulled out from the container 1 without tearing. The insert 30 is preferably loosely arranged inside the container 1. Because of its flexibility, each grasp portion 36*a*, 36*b* of the insert can be easily bent outwards by a consumer for better grasping said grasp region 36*a*, 36*b*, which increases user friendliness. Protrusions or impressions on the grasp region 36*a*, 36*b* further facilitate outward bending and grasping.

Although the insert 30 is preferably made of thin paper material, the insert 30 comprises a stable three-dimensional structure which facilitates removal, due to a first bending 37*a* on at least a first side, which forms a first side panel 35*a*. The stability of the insert's structure during manufacturing can be furthermore increased by a second bending 37*b* of the insert 30 on a second side, which forms a second side panel 35*b* (see FIGS. 6 to 7*b*). In case the forming of a second side panel 35*b* is not desired, it might be already sufficient for improving the stability of the structure to provide a small second bending 37*b* as can be seen in FIGS. 3 to 4*b*.

FIGS. 8*a* and 8*b* show a third embodiment of an insert 30. In this embodiment, compared to the insert 30 of the first embodiment, a lower portion of the first bending portion 37*a* is cut off at cut line 32. Thus, the first bending portion 37*a* and the lower left area of the front panel 33 comprises an upwardly inclined border line 32 that decreases the height of the insert 30 in this area. Such a configuration may be more advantageous compared to the first and second embodiment because the insert 30 comprises a natural tendency to tilt because of an eccentric pulling force applied by a consumer when he pulls at one grasp portion 36*a*, 36*b*. The lower part 37*a of the first bending portion 37***a* is cut off as this part 37*a would interfere with the outer housing 10 during said tilting motion of the insert 30. The shape of the insert 30 of the third embodiment shown in FIG. 8***a* promotes the insert's 30 natural tilting during extraction from a container 1. In the shown third embodiment, approximately 50% of the height of the first bending portion 37*a* are cut off, as can be seen best in the comparative illustration between the first (dotted line) and the third embodiment (straight line) as it is shown in FIG. 8*b*. As a result, extraction of the insert 30 is improved while said third embodiment does not reduce manufacturing stability nor reduce communication space on the front panel 33 of the insert 30.

Furthermore, FIG. 9 shows a fourth embodiment of an insert 30. In this embodiment the cut, and respectively cut line 32, is diagonally extended into the lower part of front panel 33. This extended cut line 32 further improves an insert 30 removal by tilting the front panel and maintains stability during manufacturing. However, the communication area on the front panel 33 of the insert 30 is slightly reduced.

In FIGS. 10*a*-10*c* a fifth embodiment of an insert 30 is shown. In this embodiment the second bending portion 37*b* is removed due to its interference with the above-mentioned tilting motion. However, the removal of the second bending portion 37*b will have an impact on the stability of the insert 30 during manufacturing. Thus, it is suggested in this case to apply some adhesive between the front panel 33 of the insert 30 and the front wall 23 of the inner package 20 to stabilize the insert 30 during manufacturing (e.g. during step 104**). Thereby, it is important that the adhesive strength is selected to withstand manufacturing forces and allow its removal by a user as it will be described below with reference to the manufacturing process.

Finally, the fifth embodiment can be provided similar to the first embodiment with only a first bending portion 37*a* (see FIG. 10*a*), or similar to the fourth embodiment with an extended cut line 32 (see FIG. 10*b*). For the latter case, FIG. 10*c* shows an overlay illustration between the first embodiment (dotted line) and the fifth embodiment (straight line) with the cut-off parts 37*a and 37*b. As a result, said insert 30 of the fifth embodiment is easy to extract, but comprises a reduced communication space at the front panel 33 and a reduced stability during manufacturing.

Altogether, the embodiments of an insert 30 shown in FIGS. 3 to 10*c* comprise a front panel 33 having a height H in a longitudinal direction L of the container 1. Preferably, the height H of the front panel 33 is preferably between 40% and 100% of the height of the front wall 13 of the box portion 12, for example between 50% and 95%. In the described embodiments of an insert 30, the height H of the front panel 33 is about 50% of the height of the front wall 13 of the box portion 12. The grasp regions 36*a*, 36*b* extend significantly beyond this height H in said direction L. By this structure it is secured that the grasp portions 36*a*, 36*b* are visible inside the container 1, while the front panel 33 can be fully hidden in-between the front walls 13, 23 of the box portion 12 and the inner package 20.

The width W of the front panel 33, i.e. the maximum extension of the front panel 33 along a transversal direction T, is preferably between 40% and 100% of the width of the front wall 13 of the box portion 12, for example between 50% and 90%. In the described embodiments, the width of the front panel 33 is about 85% of the width of the front wall 13 of the box portion 12. Thereby, some space at the front side is left for the bending portions 37*a*, 37*b*.

Preferably, the overall height of the insert 30 from a bottom edge of the front panel 30 to a peak point 39 of the grasp region 36*a*, 36*b* is between 50% and 100% of the height of the inner package 20 in said direction L. In some embodiments, the overall height of the insert 30 from a bottom edge of the front panel 30 to a peak point 39 of the grasp region 36*a*, 36*b* can substantially correspond to a height of the inner package 20 in said direction L, as shown in FIG. 1. In other embodiments, the overall height of the insert 30 from a bottom edge of the front panel 30 to a peak point 39 of the grasp region 36*a*, 36*b* is between 55% and 85% of the height of the inner package 20 in said direction L, preferably between 65% and 75%, as shown in FIGS. 11-14.

Figure 11C:
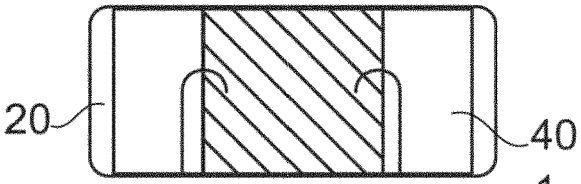
Figure 11B:
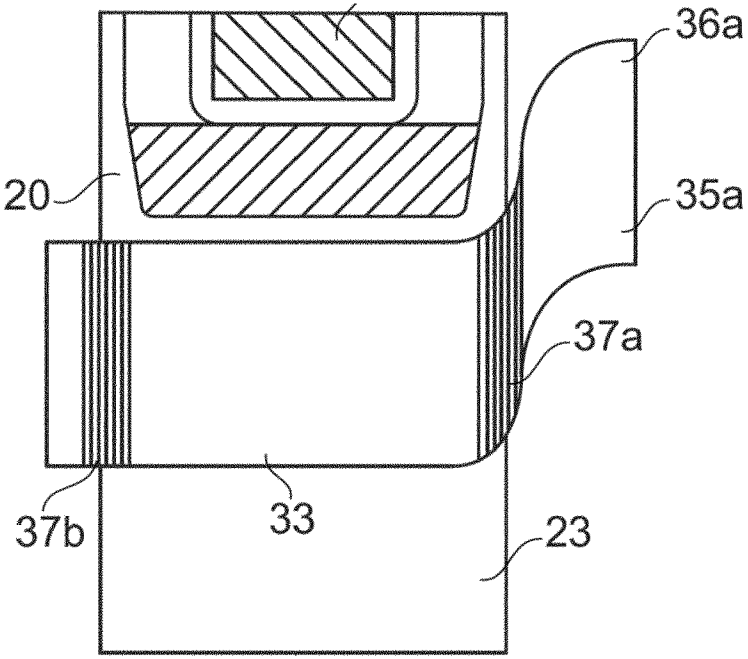
Figure 11D:
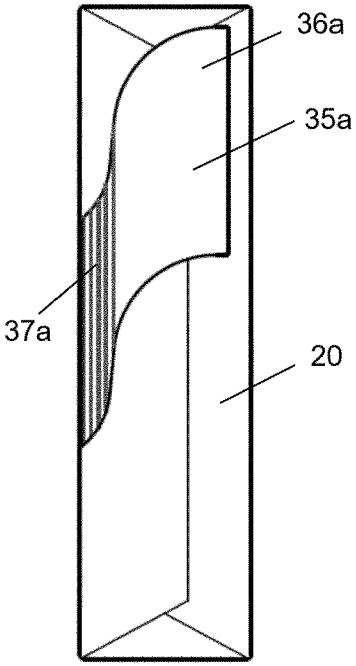
Figure 11A:
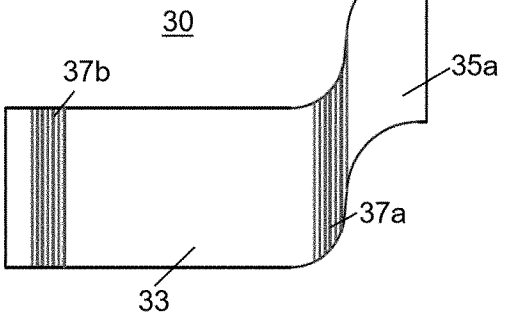
Figures 12A, 12B, 12C, 12D:
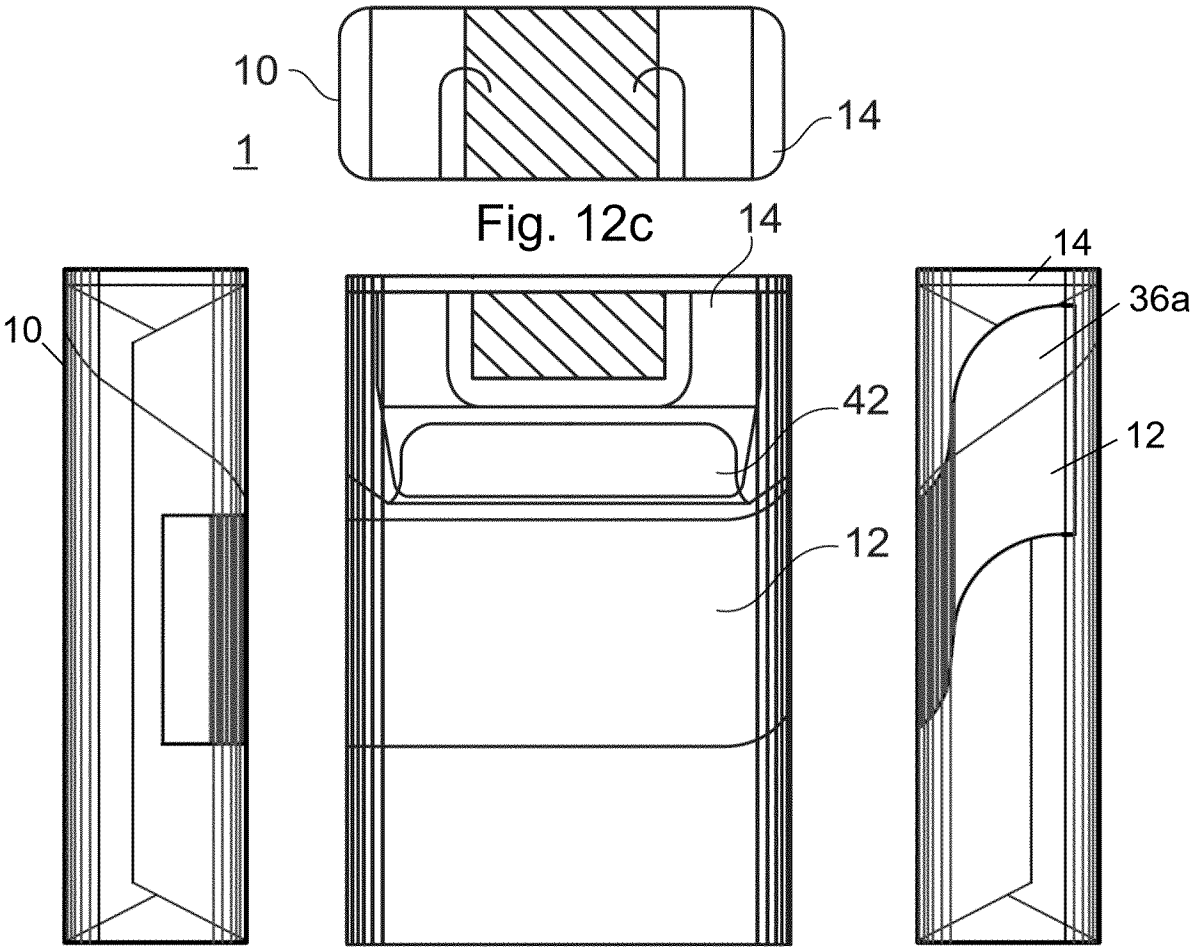
Figure 13D:
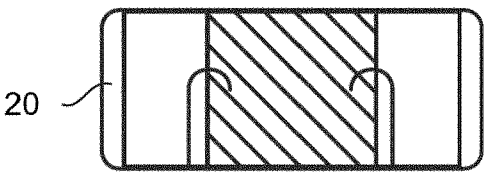
Figure 13C:
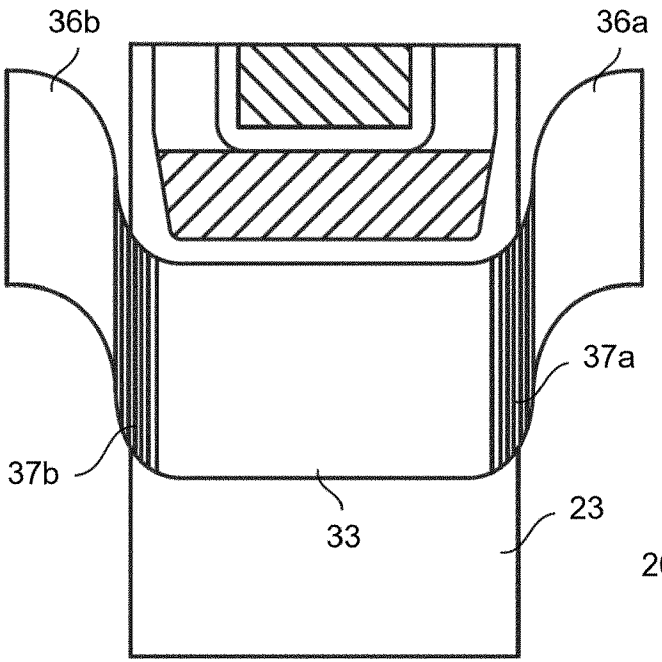
Figure 13E:
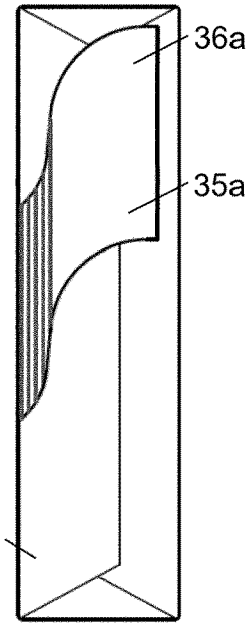
Figure 13B:
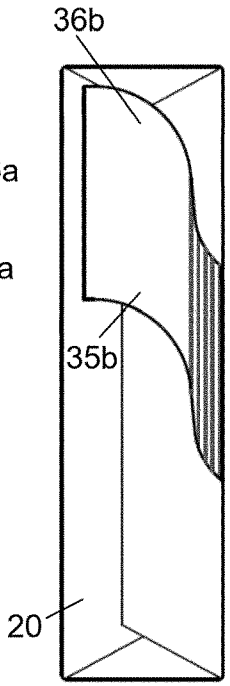
Figure 13A:
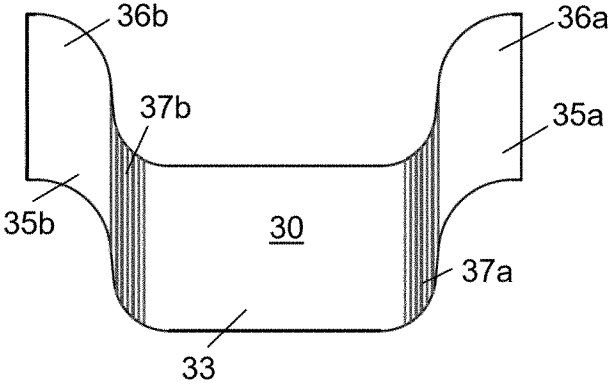
Figures 14A, 14B, 14C, 14D:
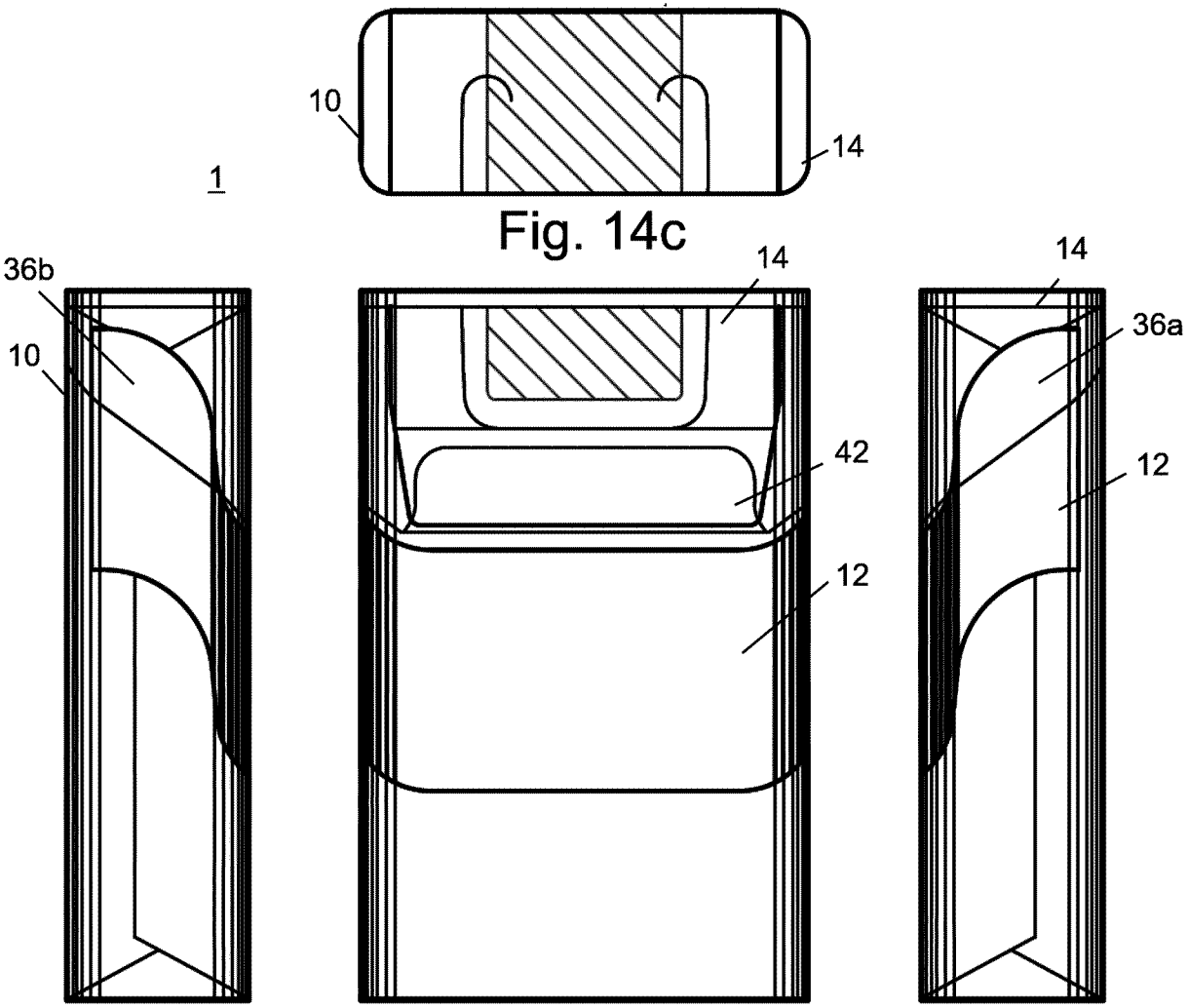

During manufacturing of the container 1 in one embodiment of the manufacturing process the first or second embodiment of an insert 30 (FIG. 11*a*, 13*a*) is applied onto an embodiment of an inner package 20. Particularly the embodiment of an insert 30 can be at first applied onto the front wall 23 of the inner package 20 (FIG. 11*b*, 13*c*). Afterwards, the first and second side panels 35*a*, 35*b* of the insert 30 are bent around the inner package 20 to abut against it (see FIGS. 11*c*, 11*d*, 13*b*, 13*d* and 13*e*). Thereby, the insert 30 is arranged at a distance to the reclosable flap 40 (see FIGS. 11*b*, 13*c*). After that, the outer housing 10 is wrapped around the inner package 20 with the insert 30 to form a container 1 (FIGS. 12*a*-12*d* and 14*a*-14*d*).

In FIG. 15 an embodiment of a packaging facility 100 for the manufacturing of a container 1 is illustrated. The packaging facility 100 essentially comprises six production lines PL-1 to PL-6. A first production line PL-1 provides the sheet material 30*s* of the inserts 30. The sheet material can be provided on a continuous supply sheet. Thereby, in step 102 one of the inserts 30 is removed from the supply sheet and individualized.

At a second production line PL-2 bundles of consumer goods 5, here cigarettes, are wrapped 106 into a different sheet material 20S that forms the inner package 20. This sheet material can be for instance a metallized plastics laminate film or aluminized paper. The bundle of consumer goods 5 is held together by means of a series of inner frames, that are arranged around a number of pieces of consumer goods 5, here cigarettes. The wrapping is preferably done by rollers. Thereby, the production of the inner package is performed via several folding states 20*. The folding of the inner package can be performed during further transportation of the inner package inside the manufacturing facility 100.

After that, in production line PL-3, an individualized insert 30 is applied onto an inner package 20 in step 104. Thereby, the flat inserts 30 are applied onto the front wall 23 of the inner package 20. Subsequent to the application of the insert 30 onto the inner package 20 in step 104 at least the first side panel 35*a* of the insert 30 is bent around the inner package 20. In case the insert 30 comprises also a second side panel 35*b*, this second side panel 35*b* is simultaneously bent around the inner package 20. However, in case no second side panel 35*b* and/or no second bending portion 37*b* is provided to the insert 30, it may be favorable to apply some adhesive between the front panel 33 of the insert 30 and the front wall 23 of the inner package 20 to stabilize the insert 30 during manufacturing, e.g. during step 104. When doing so, it is important that the adhesive strength is selected to withstand manufacturing forces but to allow the removal of the insert 30 by a consumer. Manufacturing forces can be, for example, acceleration forces during transportation through the manufacturing facility. If the adhesive strength would be too high, the consumer would be unable to remove the insert. If the adhesive strength would be too low, then the insert might not be stable during manufacturing and jam the manufacturing facility 100.

Thereby, the bending of the side panels 35*a*, 35*b* can be performed during further transportation of the inner package 20 through the manufacturing facility 100. This saves time and increases the production volume.

In one embodiment of the manufacturing process, a reclosable flap 40 is applied to the inner package prior to the application of the insert, i.e. between steps 106 and 104. In another embodiment of the production process, said reclosable flap 40 is applied to the inner package after step 104 and before step 108.

A fourth production line PL-4 provides sheets of flat cardboards 10*s* from a corresponding supply to a transportation line of the inner package 20 with the insert 30. Therefore, in step 108 one cardboard 10*s* is associated to each inner package 20 with the insert 30.

Thereafter, in production line PL-5 the cardboard 10*s* passes through several bending stages 10* and is glued at appropriate edges to finally form the outer housing 10 and the container 1, respectively. Finally, the container 1 may be wrapped in a transparent plastic foil for a water-proof and integrity sealing.

In a last production line PL-6 the finished containers 1 are transported to successive facilities (not shown) preferably by a conveyor belt, usually for packaging large numbers of containers into larger packets for shipping. In between these steps the products or intermediate products are checked several times and damaged ones are rejected. The packaging process usually is fully automatic.

In another embodiment of the manufacturing of a container 1, however, step 104 is replaced by an insert introduction step, which is performed after forming the complete container 1 without wrapping in plastic foil. The introduction of the insert 30 is performed by means of appropriate tools, which slightly widen the container 1 in the respective regions, i.e. between the front walls 13, 23 of the box portion 12 and the inner package 20 and at least the first side walls 15*a*, 25*a* of the box portion and the inner package 20, in order to facilitate the introduction of the insert 30. In this embodiment, step 106 is directly followed by step 108 without step 104 in-between. The insert introduction step is then performed preferably between production lines PL-5 and PL-6.

LIST OF REFERENCE SIGNS

1 container
5 consumer goods
10 outer housing
10*s* cardboard
10* intermediate steps
12 box portion
13 front wall
14 lid portion
15*a* first side wall
15*b* second side wall
16 upper edge
20 inner package
20*s* sheet material
20* intermediate steps
22 access opening
23 front wall
24 upper end
25*a* first side wall
25*b* second side wall
30 insert
30*s* sheet material
32 cut line
33 front panel
34 upper edge
35*a* first side panel
35*b* second side panel
36*a* first grasp portion
36*b* second grasp portion
37*a* first bending portion

37*a** cut-off part of first bending portion
37*b* second bending portion
37*b** cut-off part of second bending portion
38 upper-front edge
39 peak point
40 reclosable flap
42 attachment portion
44 non-adhesive region
46 adhesive region
50 indicium
100 packaging facility
102 insert forming step
104 insert application step
106 sheet material application step
108 cardboard application step
H height
L longitudinal direction
PL-X production line X (X=1 to 6)
T transversal direction
W width

The invention claimed is:

1. A container for consumer goods comprising:

a. an outer housing comprising a box portion extending along a longitudinal direction and a hinged lid portion for closing the container, wherein the hinged lid portion is pivotable between an open position and a closed position;

b. an inner package for storing consumer goods, wherein the inner package is arranged within the outer housing and the inner package comprises an access opening through which consumer goods can be taken out;

c. an insert that can be pulled out of the container, comprising a front panel and at least a first side panel, wherein the front panel and the first side panel are connected to each other, and wherein d. the front panel is arranged between a front wall of the inner package and a corresponding front wall of the box portion, and the first side panel is arranged between a first side wall of the inner package and a corresponding first side wall of the box portion; and e. the first side panel comprises a first grasp portion that extends above said first side wall of the box portion in the longitudinal direction, when the insert is in a retracted position.

2. The container according to claim 1, wherein the first grasp portion extends beyond a height of the front panel in said longitudinal direction and wherein the front panel is completely arranged below an upper edge of said front wall of the box portion, when the insert is in the retracted position.

3. The container according to claim 1, further comprising a reclosable flap which is connected and moveable relative to the inner package, wherein the access opening can be covered by said reclosable flap for sealing the inner package.

4. The container according to claim 3, wherein the insert and the reclosable flap do not overlap, when the insert is in the retracted position.

5. The container according to claim 1, wherein the first grasp portion extends to an upper end of the inner package.

6. The container according to claim 1, wherein the insert further comprises a second side panel arranged at an opposite side to the first side panel, and the front panel and the second side panel are connected to each other, wherein the second side panel is arranged between a second side wall of the inner package and a corresponding second side wall of the box portion.

7. The container according to claim 6, wherein the second side panel comprises a second grasp portion that extends above said second side wall of the box portion in said longitudinal direction, when the insert is in the retracted position.

8. The container according to claim 7, wherein the second grasp portion extends beyond the height of the front panel in said longitudinal direction.

9. The container according to claim 7, wherein the first grasp portion and/or the second grasp portion comprises an arch-shaped upper-front edge.

10. The container according to claim 7, wherein the first grasp portion and/or the second grasp portion comprises an indicium, indicating that the insert can be pulled out of the container.

11. An insert for insertion into a container for consumer goods, the insert comprising:

a. a front panel, a first side panel, and a second side panel, wherein b. the first side panel is connected to the front panel and the first side panel is arranged at an angle to the front panel;

c. the second side panel is connected to the front panel at an opposite side to the first side panel; and d. the first side panel comprises a first grasp portion that extends beyond a height of the front panel and is designed for pulling the insert out of a container.

12. The insert according to claim 11, wherein the second side panel comprises a second grasp portion that extends beyond the height of the front panel in said longitudinal direction.

13. A method of manufacturing a container for consumer goods, the method comprising the steps of:

a. providing a charge of consumer goods;

b. wrapping sheet material around the charge of consumer goods for forming an inner package, the inner package including an access opening through which the consumer goods can be taken out;

c. arranging a separate insert onto the inner package, the insert comprising a front panel and at least a first side panel, wherein the first side panel is connected to the front panel, and the first side panel and the front panel are arranged at an angle to each other, and the first side panel comprises a first grasp portion that extends beyond a height of the front panel in a longitudinal direction; and d. forming an outer housing of the container around the inner package and the insert such that the first side panel of the insert is arranged between a first side wall of the inner package and a first side wall of the outer housing and the front panel of the insert is arranged between a front wall of the outer housing and a front wall of the inner package, the outer housing comprising a box portion extending along a longitudinal direction and a hinged lid portion for closing the container, wherein the hinged lid portion is pivotable between an open position and a closed position.

14. The method according to claim 13, wherein:

the step of arranging the separate insert is performed prior to the step of forming the outer housing.

15. The method according to claim 13, further comprising a step of applying a reclosable flap to the inner package after arranging the insert onto the inner package.

16. The method according to claim 13, wherein:

the step of arranging the separate insert is performed after the step of forming the outer housing and performed by fitting the insert between the inner package and the outer housing.

* * * * *